United States Patent [19]

Kanowsky et al.

[11] 4,031,577

[45] June 28, 1977

[54] CONVERTIBLE SOFA BED

[75] Inventors: Vincent C. Kanowsky, Newport Beach; Lloyd A. Blanc, Downey, both of Calif.

[73] Assignee: Allied Upholstery Mfg. Inc., Lynwood, Calif.

[22] Filed: Jan. 5, 1976

[21] Appl. No.: 646,625

[52] U.S. Cl. ..... 5/17; 5/29

[51] Int. Cl.[2] ..... A47C 17/14

[58] Field of Search ..... 5/12 B, 18 B, 18 R, 5/13, 17, 22, 29, 51 L, 51 F, 51 K, 55 B

[56] References Cited

UNITED STATES PATENTS

| | | | |
|---|---|---|---|
| 2,907,053 | 10/1959 | Fox | 5/12 |
| 3,005,997 | 10/1961 | Fox | 5/17 |
| 3,113,325 | 12/1963 | Kamp | 5/17 |
| 3,167,788 | 2/1965 | Murphy et al. | 5/17 |
| 3,299,446 | 1/1967 | Blise et al. | 5/22 |
| 3,877,087 | 4/1975 | Harty | 5/13 |
| 3,925,834 | 12/1975 | Johnson et al. | 5/13 |

FOREIGN PATENTS OR APPLICATIONS

| | | | |
|---|---|---|---|
| 363,770 | 9/1962 | Switzerland | 5/17 |

*Primary Examiner*—Casmir A. Nunberg
*Attorney, Agent, or Firm*—Harris, Kern, Wallen & Tinsley

[57] ABSTRACT

A convertible sofa bed particularly suited for use as a single bed. A sofa with a sloping seat resting on the frame partially beneath the back, with the forward seat support concealed behind the sofa frame front edge when the seat is in the retracted sofa position. A seat movable to an extended bed position and supported horizontally along opposite edges for stability, with the front support resting on the floor and with the rear support resting on the frame. Interengaging latch members on the seat and frame for limiting upward movement of the seat relative to the frame when in the retracted and extended positions.

8 Claims, 5 Drawing Figures

CONVERTIBLE SOFA BED

BACKGROUND OF THE INVENTION

This invention relates to convertible sofa beds suitable for sitting and for sleeping.

A convertible sofa bed should be simple, inexpensive, easy to operate and stable when in the retracted and extended positions. When in the sofa configuration, the unit should be attractive with pleasing proportions and sloped back and seat for sitting. When in the bed configuration, the bed should be horizontal and supported at the corners or edges to avoid rocking and tilting.

A variety of designs have been proposed in the past, including those shown in U.S. Pat. Nos. 1,140,368; 2,573,892; 2,907,053; 2,937,384; 3,005,997; 3,167,788; and 3,299,446. These prior art units have various disadvantages. Some require complex mechanical linkages to achieve the movement between the sofa and bed configurations. One prior art unit utilizes a simpler mechanical linkage with an overhanging or cantilevered seat for the bed configuraion with a resultant lack of stability. The stability is improved in some prior art units by utilizing additional legs at the front edge of the moving seat, however the legs are exposed at the forward edge of the sofa when in the sitting configuration resulting in an unattractive design.

It is an object of the present invention to provide a new and improved convertible sofa bed incorporating a simple mechanical mechanism and one which is easily moved between the sitting and sleeping configuration. A further object is to provide such a convertible sofa bed where the moving seat rests on the sofa frame when in the retracted or sitting configuration with the seat support legs behind the forward edge of the sofa frame, and with the seat supported at opposite sides or at the four corners when in the extended or sleeping configuration.

SUMMARY OF THE INVENTION

The present invention comprises a convertible sofa bed with fixed frame and moving seat. The frame typically is of wood with a base having a front edge and a back having an overhanging edge. The frame may be upholstered in the conventional manner. The seat is coupled to the frame by links at each end of the seat pivotally mounted on the seat and frame. The seat is movable between a retracted sofa position and an extended bed position. When in the retracted position, the seat rests on the frame with a sloping upper surface positioned partially under the overhanging edge of the back and with the front support for the seat positioned behind the front edge of the base. The forward edge of the seat is lifted up and outward over the front edge of the base to the extended sleeping position. The front support of the seat now rests on the floor and the rear edge of the seat rests on the frame. The base of the frame includes a guide, typically a ramp which engages and raises the rear edge of the seat to the horizontal position for sleeping. A hold down latch is provided for holding the rear edge of the seat down when in the extended and retracted positions.

DESCRIPTION OF THE PREFERRED EMBODIMENT

Figure 1:
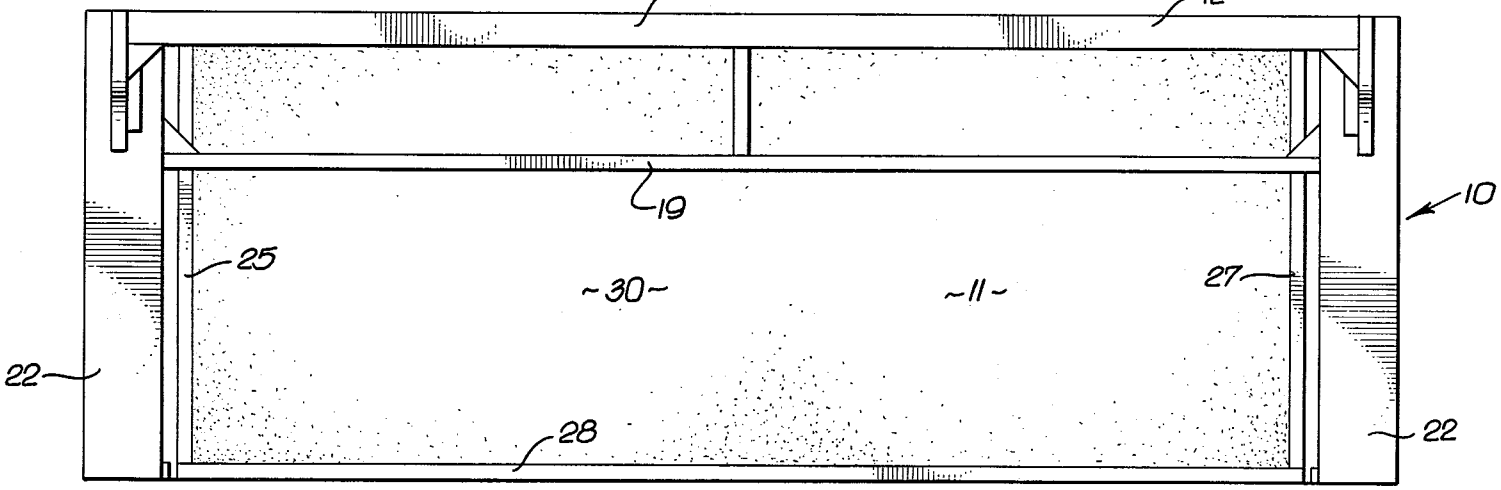
FIG. 1 is a top view of a convertible sofa bed showing the frame and seat prior to upholstering and incorporating the presently preferred embodiment of the invention.
Figure 2:
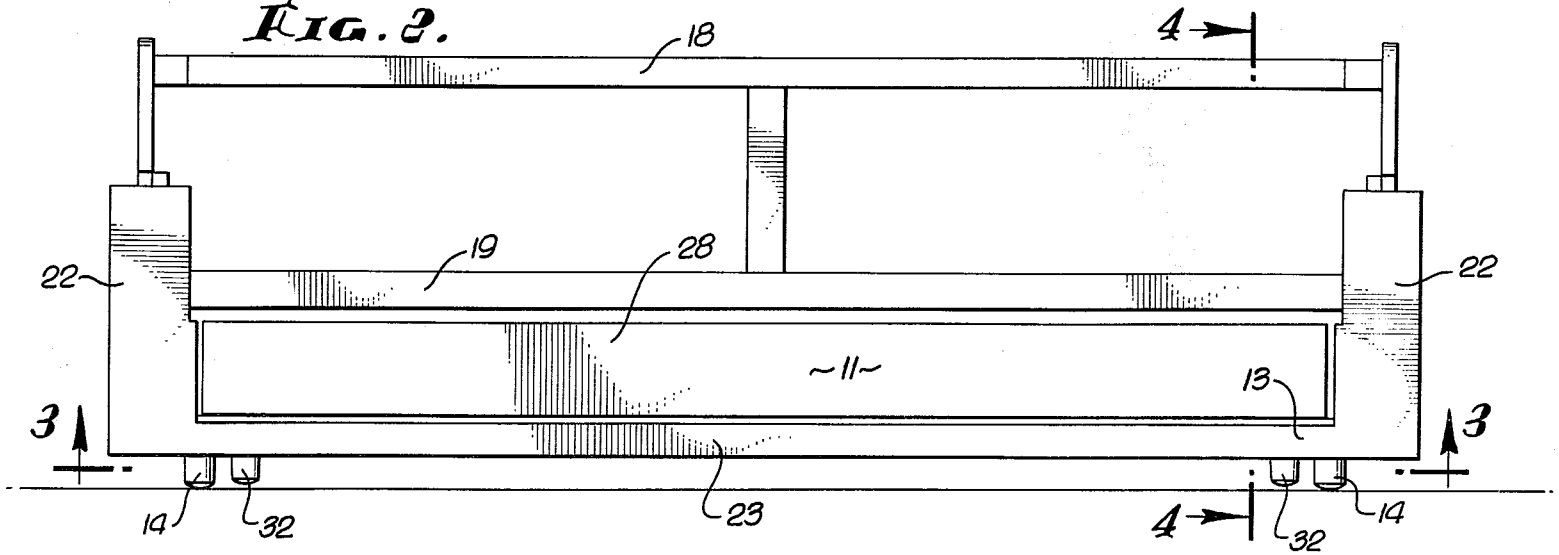
FIG. 2 is a front view of the sofa bed of FIG. 1.
Figure 3:
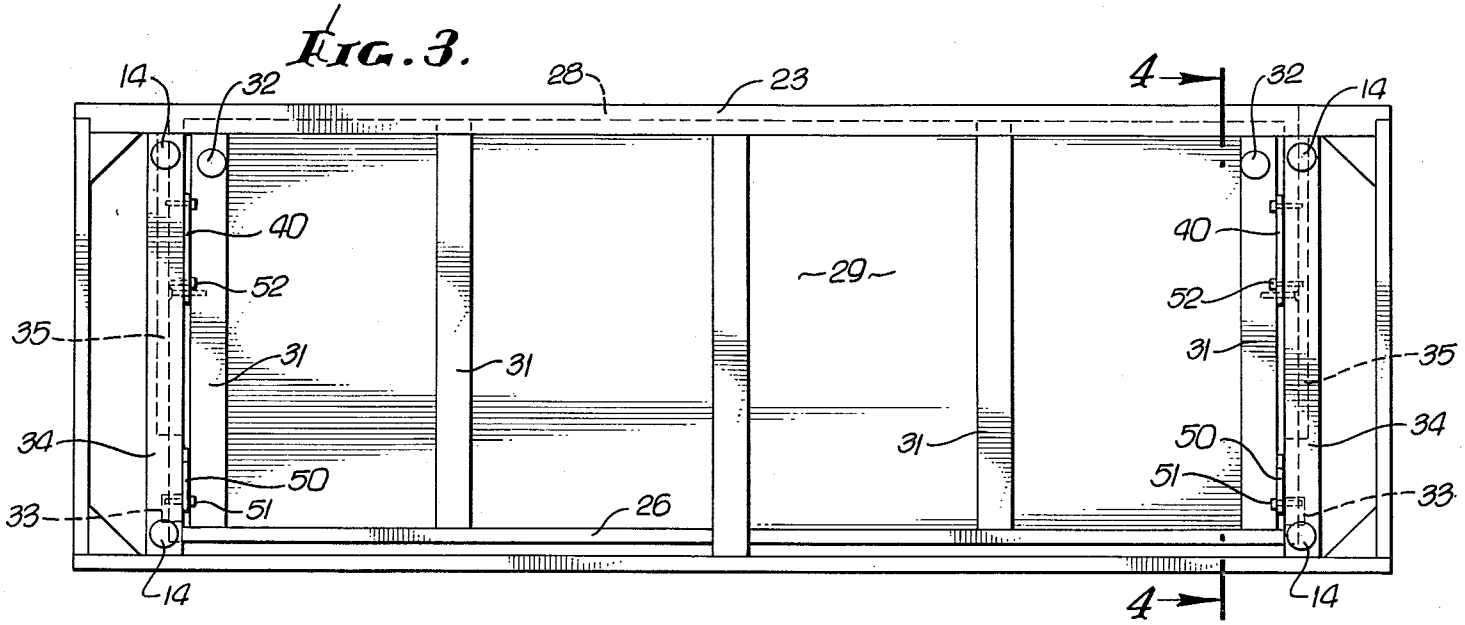
FIG. 3 is a bottom view of the sofa bed of FIGS. 1 and 2.
Figure 5:
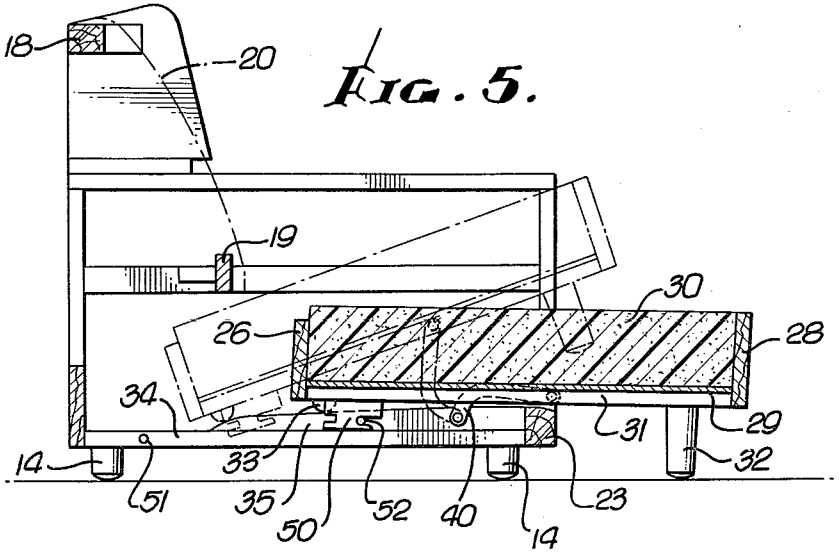
FIG. 5 is a view similar to that of FIG. 4 showing the seat in the extended sleeping configuration.
Figure 4:
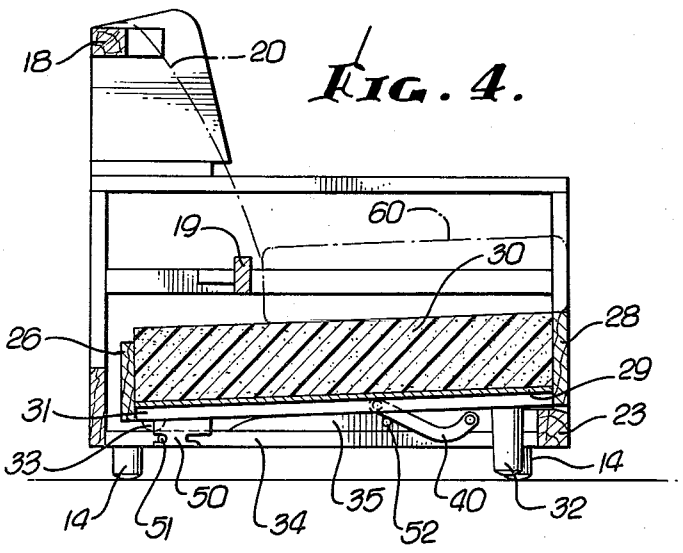
FIG. 4 is a sectional view taken along the line 4—4 of FIGS. 2 and 3.

The sofa bed shown in the drawings comprises a frame 10 and a seat 11, with the seat movable between a retracted sofa position shown in FIG. 4 and an extended bed position shown in FIG. 5. The frame 10 may be made of wood in the conventional manner and includes a back 12 and a base 13, with the base supported on legs 14. The frame is illustratedd in the drawings prior to upholstering. The back of the frame includes an upper horizontal member 18 and a lower horizontal member 19 to which springs may be attached for supporting the upholstery of the back indicated by the phantom line 20. The base of the frame includes arms 22 at each end and a horizontal front edge member 23.

The seat 11 includes a housing comprising side members 25, 26, 27 and 28 and a bottom member 29 resting on slats 31, and a mattress 30 carried in the housing. A support is provided for the front edge of the seat, typically comprising legs 32 depending from the end slats 31.

Glides or bosses 33 are carried on the side members 25, 27 of the seat housing adjacent the rear edge and ride on bottom rails 34 and ramp members 35 of the base of the frame.

A link 40, typically a metal strap, is pivotally connected to the seat and to the base of the frame at each end, preferably to the side members 25, 27 of the seat and to the ramp members 35 of the base.

An interengaging latch mechanism is provided on the seat and base for retaining the seat in position when in the retracted configuration and when in the extended configuration. In the preferred embodiment illustrated, a plate 50 is carried on each side member 25, 27 of the seat and has a rearwardly opening notch for engaging a pin 51 and a forward opening notch for engaging a pin 52, with pin 51 on the rail 34 and pin 52 on the ramp member 35.

The sofa bed is shown in the sofa configuration in FIG. 4, with the seat retracted and partially under the overhanging back member 19. A cushion 60 may be placed on the exposed portion of the seat if desired. The seat rests on the base, typically by engagement with the ramp members 35, although the seat may also engage the base at the glides 33 and the front edge member 23 if desired. In this configuration, the seat support legs 32 are concealed behind the base front edge 23, with the seat side member 28 in line with the base front edge member 23.

The seat is moved to the sleeping position by raising the front edge as shown in phantom lines in FIG. 5, moving the legs 32 upward and forward over the base front edge 23, and then lowering the seat front edge to the position shown in solid lines in FIG. 5. During this movement, the glides 33 ride up onto the ramp members 35 raising the rear edge of the seat so that the seat is now in a horizontal position suitable for sleeping. The links 40 serve to limit the movement of the seat with respect to the frame.

With the seat in the extended sleeping position of FIG. 5, the seat is supported along the front edge by the legs 32 and along the rear edge by the glides 33, preferably with a clearance between the seat and the base front edge 23. This provides a stable suspension for the bed eliminating any possibilities of rocking or tilting. If desired, a larger sleeping surface can be provided by hinging the seat side member 28 along a horizontal line and slitting the mattress 30 along a horizontal plane, with the upper portion of the mattress and the side member 28 being pivoted 180° clockwise as viewed in FIG. 5, with additional support legs provided for the pivoted portion of the mattress.

When the seat is in the retracted position of FIG. 4, the latch plates 50 engage the pins 51 limiting upward and rearward movement of the seat. Similarly, when the seat is in the extended position of FIG. 5, the latch plates 50 engage the pins 52 limiting forward and upward motion of the seat.

The structure of the present invention provides a sofa of conventional configuration which is simply and easily converted to a bed with stable supports. When in the sofa configuration, the bed supports are concealed and there is no indication that the piece of furniture may also serve as a bed.

We claim:

1. In a convertible sofa bed, the combination of:
a frame having a base and a back, said base having a front support edge and said back having an overhanging edge;
a seat movable between
a retracted sofa position resting on said frame, with a sloping upper surface positioned partially under said overhanging edge and having front support means adjacent the front edge of said seat and positioned behind said base front support edge thereby concealing said seat front support means behind said base front support edge, and
an extended bed position with said front support means in front of said base front support edge for resting on the floor supporting the seat and having rear support means adjacent the rear edge of said seat,
said base including guide means for said seat rear support means for positioning said seat horizontally; and
a link at each end of said seat pivotally connected to said seat and to said frame.

2. A convertible sofa bed as defined in claim 1 including interengaging latch means on said seat and frame for limiting upward movement of said seat relative to said frame when in said retracted and extended positions.

3. A convertible sofa bed as defined in claim 2 wherein said latch means includes a latch member at each end of said seat and forward and rearward pins at each end of said base, with said latch members engaging the respective rearward pins when said seat is in the sofa position and engaging the respective forward pins when said seat is in the bed position.

4. A convertible sofa bed as defined in claim 1 with said seat spaced above said frame front edge when in the extended position with said frame and seat front support means on a flat surface.

5. A convertible sofa bed as defined in claim 1 wherein said base guide means includes a ramp member at each end of said base, and said seat rear support means includes a boss riding on each ramp member.

6. A convertible sofa bed as defined in claim 1 wherein said seat member includes a mattress in a mattress housing, with said front and rear support means carried on said housing.

7. A convertible sofa bed as defined in claim 1 including a removable cushion resting on said seat in front of said back when said seat is in the retracted sofa position.

8. In a convertible sofa bed, the combination of:
a frame having a base and a back, said base having a front support edge and said back having an overhanging edge;
a seat movable between
a retracted sofa position resting on said frame, with a sloping upper surface positioned partially under said overhanging edge and having front support means adjacent the front edge of said seat and positioned behind said base front support edge thereby concealing said seat front support means behind said base support edge, and
an extended bed position with said front support means in front of said base front support edge for resting on the floor supporting the seat and having rear support means adjacent the rear edge of said seat,
said base including guide means for said seat rear support means for positioning said seat horizontally;
a link at each end of said seat pivotally connected to said seat and to said frame; and
interengaging latch means on said seat and frame for limiting upward movement of said seat relative to said frame when in said retracted and extended positions,
said latch means including a latch member at each end of said seat and forward and rearward pins at each end of said base, with said latch members engaging the respective rearward pins when said seat is in the sofa position and engaging the respective forward pins when said seat is in the bed position.

* * * * *